US010883744B2

(12) United States Patent
Johnson et al.

(10) Patent No.: US 10,883,744 B2
(45) Date of Patent: Jan. 5, 2021

(54) CONVERTING COMPRESSOR TO VARIABLE VI COMPRESSOR

(71) Applicant: TRANE INTERNATIONAL INC., Davidson, NC (US)

(72) Inventors: Jay H. Johnson, Houston, MN (US); Robert S. Bakkestuen, West Salem, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 105 days.

(21) Appl. No.: 16/006,392

(22) Filed: Jun. 12, 2018

(65) Prior Publication Data

US 2018/0356128 A1 Dec. 13, 2018

Related U.S. Application Data

(60) Provisional application No. 62/518,385, filed on Jun. 12, 2017.

(51) Int. Cl.

| | |
|---|---|
| ***F04B 13/00*** | (2006.01) |
| ***F25B 1/02*** | (2006.01) |
| ***F25B 1/047*** | (2006.01) |
| ***F25B 31/00*** | (2006.01) |
| ***F04B 39/14*** | (2006.01) |
| ***F04D 3/02*** | (2006.01) |
| ***F04C 18/16*** | (2006.01) |
| ***F04C 28/12*** | (2006.01) |
| ***F04C 28/26*** | (2006.01) |

(52) U.S. Cl.

CPC ..... *F25B 1/02* (2013.01); *F04B 13/00* (2013.01); *F04B 39/14* (2013.01); *F04C 18/16* (2013.01); *F04C 28/12* (2013.01); *F04C 28/26* (2013.01); *F04D 3/02* (2013.01); *F25B 1/047* (2013.01); *F25B 31/00* (2013.01); *F05B 2230/80* (2013.01)

(58) Field of Classification Search

CPC ..... F04C 28/12; F04C 28/26; F25B 1/047; F04B 13/00; F04D 3/02

See application file for complete search history.

(56) References Cited

U.S. PATENT DOCUMENTS 3,936,239 A * 2/1976 Shaw ..... F04C 28/125 417/315

4,335,582 A * 6/1982 Shaw ..... F04C 28/06 417/310

(Continued)

*Primary Examiner* — Frantz F Jules

*Assistant Examiner* — Lionel Nouketcha

(74) *Attorney, Agent, or Firm* — Hamre, Schumann, Mueller & Larson, P.C.

(57) ABSTRACT

A screw compressor is disclosed. The screw compressor includes a suction inlet that receives a working fluid to be compressed; a compression mechanism fluidly connected to the suction inlet that compresses the working fluid; a discharge outlet fluidly connected to the compression mechanism that outputs the working fluid following compression by the compression mechanism; wherein the compression mechanism fluidly communicates with one or more outlets disposed at an intermediate location between the suction inlet and the discharge outlet, the one or more outlets being selectively fluidly connectable to the discharge outlet such that the working fluid can be provided from the one or more outlets to the discharge outlet.

16 Claims, 4 Drawing Sheets

(56) References Cited

U.S. PATENT DOCUMENTS

| | | | | |
|---|---|---|---|---|
| 4,842,501 | A * | 6/1989 | Schibbye | F04C 28/125 418/201.2 |
| 5,018,948 | A * | 5/1991 | Sjtöholm et al. | F04C 28/125 417/302 |
| 6,135,744 | A * | 10/2000 | Andersen | F04C 28/125 418/201.2 |
| 8,801,395 | B2 * | 8/2014 | Heimonen | F04C 18/16 417/307 |
| 9,664,418 | B2 * | 5/2017 | Nemit, Jr. | F25B 1/047 |
| 2012/0027632 | A1 | 2/2012 | Nemit et al. | |
| 2013/0091892 | A1 | 4/2013 | Nemit et al. | |
| 2014/0127067 | A1 | 5/2014 | Kienzle | |

* cited by examiner

CONVERTING COMPRESSOR TO VARIABLE VI COMPRESSOR

FIELD

This disclosure relates generally to a vapor compression system. More specifically, this disclosure relates to controlling a volume ratio of a compressor for a vapor compression system such as, but not limited to, a heating, ventilation, air conditioning, and refrigeration (HVACR) system.

BACKGROUND

One type of compressor for a vapor compression system is generally referred to as a screw compressor. A screw compressor generally includes one or more rotors (e.g., one or more rotary screws). Typically, a screw compressor includes a pair of rotors (e.g., two rotary screws) which rotate relative to each other to compress a working fluid such as, but not limited to, a refrigerant or the like.

SUMMARY

This disclosure relates generally to a vapor compression system. More specifically, this disclosure relates to controlling a volume ratio of a compressor for a vapor compression system such as, but not limited to, a heating, ventilation, air conditioning, and refrigeration (HVACR) system.

In an embodiment, the compressor is a screw compressor. In an embodiment, the screw compressor is used in an HVACR system to compress a working fluid (e.g., a heat transfer fluid such as, but not limited to, a refrigerant).

In an embodiment, a capacity control mechanism of the screw compressor can be converted into a variable volume ratio mechanism.

In an embodiment, the screw compressor can be retrofit to modify a fixed volume ratio screw compressor to operate as a variable volume ratio screw compressor.

In an embodiment, the variable volume ratio compressor, as modified, can include a 10-14 percent increase in part load efficiency. In an embodiment, the screw compressor can be retrofit following manufacturing, and even after operation of the fixed volume ratio screw compressor. In an embodiment, the fixed volume ratio screw compressor can be redesigned and manufactured as a variable volume ratio compressor.

In an embodiment, the screw compressor can have a variable speed drive. The variable speed drive (also referred to as a variable frequency drive) can be used, for example, to vary a capacity of the screw compressor. In such an embodiment, because the variable speed drive is used to vary the capacity, an unloading mechanism of the screw compressor can be modified to provide a variable volume ratio instead of to control capacity.

A screw compressor is disclosed. The screw compressor includes a suction inlet that receives a working fluid to be compressed. A compression mechanism is fluidly connected to the suction inlet. The compression mechanism compresses the working fluid. A discharge outlet is fluidly connected to the compression mechanism that outputs the working fluid following compression by the compression mechanism. The compression mechanism fluidly communicates with one or more outlets disposed at an intermediate location between the suction inlet and the discharge outlet. The one or more outlets are selectively fluidly connectable to the discharge outlet such that the working fluid can be provided from the one or more outlets to the discharge outlet.

A method of converting a fixed volume ratio screw compressor to a variable volume ratio screw compressor is disclosed. The method includes providing a plurality of outlets that are fluidly communicable with a compression mechanism of the fixed volume ratio screw compressor and fluidly communicable with a discharge outlet of the fixed volume ratio screw compressor. The method also includes providing a slide piston assembly that determines which of the plurality of outlets is fluidly connected with the compression mechanism and the discharge outlet.

A refrigerant circuit is disclosed. The refrigerant circuit includes a compressor, a condenser, an expansion device, and an evaporator fluidly connected. The compressor includes a suction inlet that receives a working fluid to be compressed from the evaporator. A compression mechanism is fluidly connected to the suction inlet that compresses the working fluid. A discharge outlet is fluidly connected to the compression mechanism that outputs the working fluid to the condenser following compression by the compression mechanism. The compression mechanism fluidly communicates with one or more outlets disposed at an intermediate location between the suction inlet and the discharge outlet. The one or more outlets are selectively fluidly connectable to the discharge outlet such that the working fluid can be provided from the one or more outlets to the discharge outlet.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

This disclosure relates generally to a vapor compression system. More specifically, this disclosure relates to controlling a volume ratio of a compressor for a vapor compression system such as, but not limited to, a heating, ventilation, air conditioning, and refrigeration (HVACR) system.

In an embodiment, a volume ratio of a compressor, as used in this specification, is a ratio of a volume of working fluid at a start of a compression process to a volume of the working fluid at a start of discharging the working fluid. A fixed volume ratio compressor includes a ratio that is set, regardless of operating condition. A variable volume ratio can be modified during operation of the compressor (e.g., based on operating conditions, etc.).

Screw compressors generally have a fixed volume ratio. Typically, the screw compressors are designed to operate at a maximum efficiency when operating a full load condition. As a result, when operated at conditions other than full load, the screw compressor may lose efficiency. For example, when a compressor is running at a part load operation, the compressor may over pressurize a working fluid.

Figure 1:
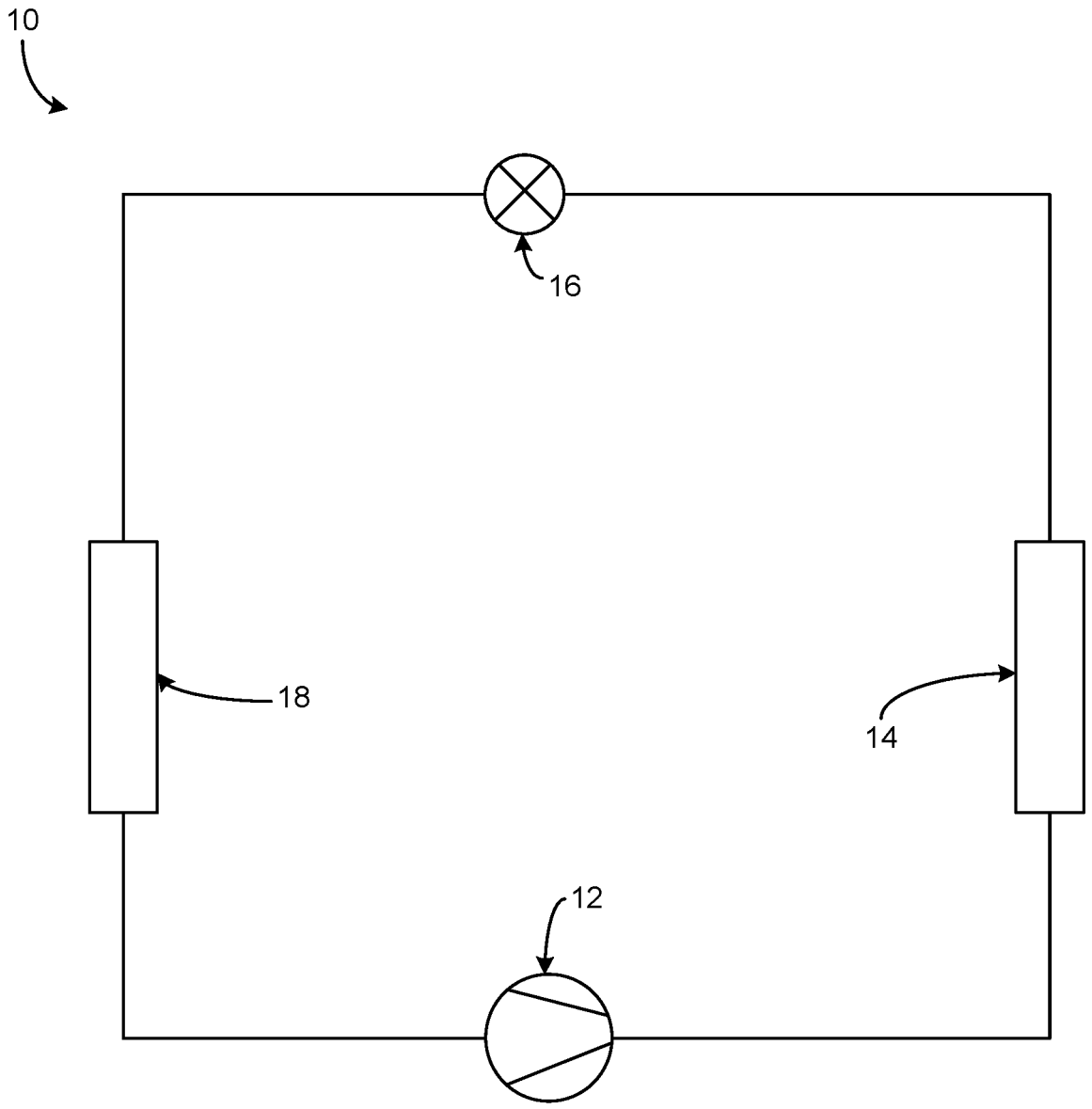
FIG. 1 is a schematic diagram of a refrigerant circuit, according to an embodiment.

FIG. 1 is a schematic diagram of a refrigerant circuit 10, according to an embodiment. The refrigerant circuit 10 generally includes a compressor 12, a condenser 14, an expansion device 16, and an evaporator 18. The compressor 12 can be, for example, a screw compressor such as the screw compressor shown and described in accordance with FIGS. 2-4 below. The refrigerant circuit 10 is an example and can be modified to include additional components. For example, in an embodiment, the refrigerant circuit 10 can include other components such as, but not limited to, an economizer heat exchanger, one or more flow control devices, a receiver tank, a dryer, a suction-liquid heat exchanger, or the like.

The refrigerant circuit 10 can generally be applied in a variety of systems used to control an environmental condition (e.g., temperature, humidity, air quality, or the like) in a space (generally referred to as a conditioned space). Examples of such systems include, but are not limited to, HVACR systems, transport refrigeration systems, or the like.

The compressor 12, condenser 14, expansion device 16, and evaporator 18 are fluidly connected. In an embodiment, the refrigerant circuit 10 can be configured to be a cooling system (e.g., an air conditioning system) capable of operating in a cooling mode. In an embodiment, the refrigerant circuit 10 can be configured to be a heat pump system that can operate in both a cooling mode and a heating/defrost mode.

The refrigerant circuit 10 can operate according to generally known principles. The refrigerant circuit 10 can be configured to heat or cool a liquid process fluid (e.g., a heat transfer fluid or medium such as, but not limited to, water or the like), in which case the refrigerant circuit 10 may be generally representative of a liquid chiller system. The refrigerant circuit 10 can alternatively be configured to heat or cool a gaseous process fluid (e.g., a heat transfer medium or fluid such as, but not limited to, air or the like), in which case the refrigerant circuit 10 may be generally representative of an air conditioner or heat pump.

In operation, the compressor 12 compresses a working fluid (e.g., a heat transfer fluid such as a refrigerant or the like) from a relatively lower pressure gas to a relatively higher-pressure gas. The relatively higher-pressure gas is also at a relatively higher temperature, which is discharged from the compressor 12 and flows through the condenser 14. The working fluid flows through the condenser 10 and rejects heat to a process fluid (e.g., water, air, etc.), thereby cooling the working fluid. The cooled working fluid, which is now in a liquid form, flows to the expansion device 16. The expansion device 16 reduces the pressure of the working fluid. As a result, a portion of the working fluid is converted to a gaseous form. The working fluid, which is now in a mixed liquid and gaseous form flows to the evaporator 18. The working fluid flows through the evaporator 18 and absorbs heat from a process fluid (e.g., water, air, etc.), heating the working fluid, and converting it to a gaseous form. The gaseous working fluid then returns to the compressor 12. The above-described process continues while the refrigerant circuit is operating, for example, in a cooling mode (e.g., while the compressor 12 is enabled).

Figure 2:
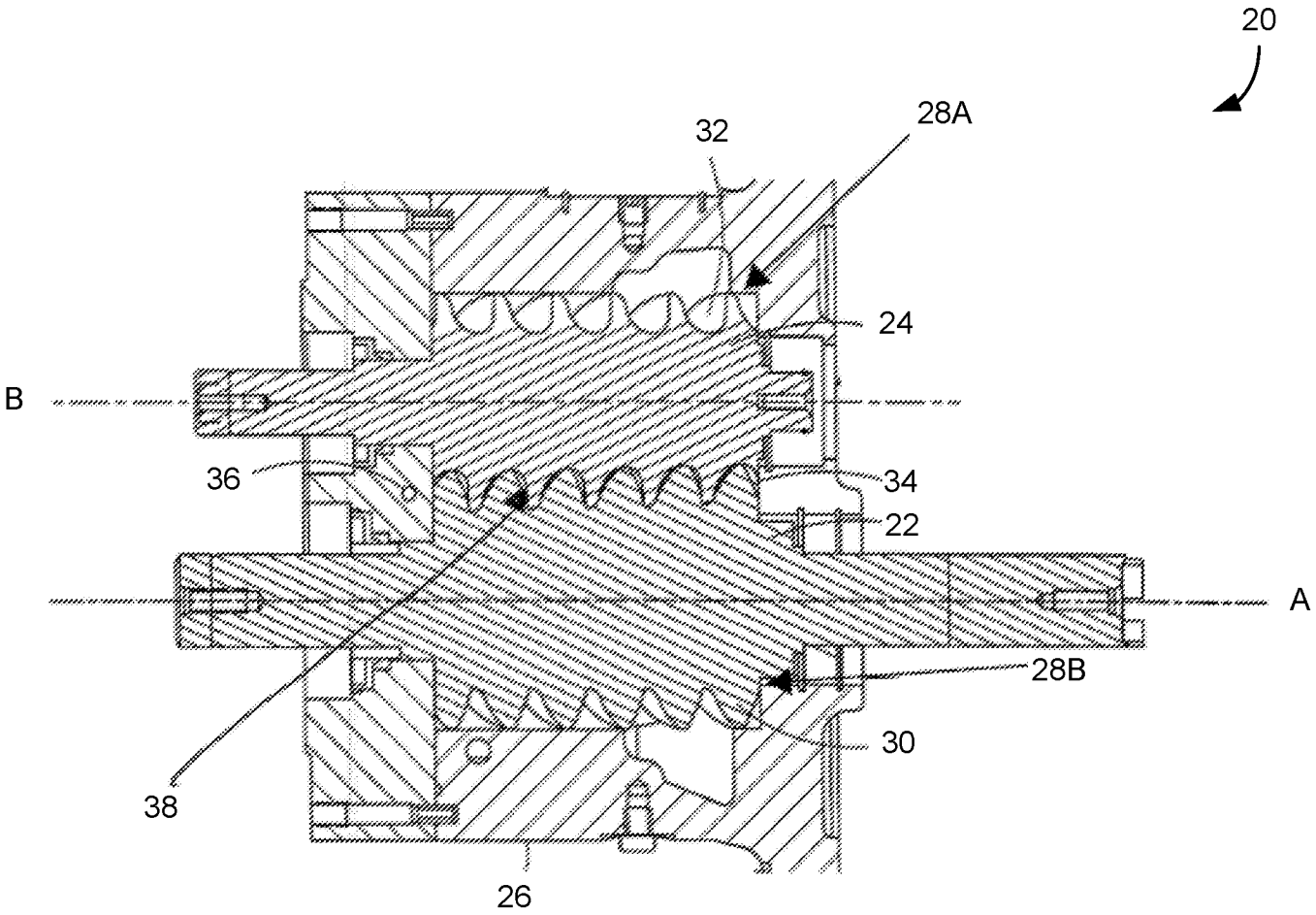
FIG. 2 illustrates a screw compressor with which embodiments as disclosed in this specification can be practiced, according to an embodiment.

FIG. 2 illustrates an embodiment of a screw compressor 20 with which embodiments as disclosed in this specification can be practiced. The screw compressor 20 can be used in the refrigerant circuit 10 of FIG. 1 (e.g., as the compressor 12). It is to be appreciated that the screw compressor 20 can be used for purposes other than in the refrigerant circuit 10. For example, the screw compressor 20 can be used to compress air or gases other than a heat transfer fluid or refrigerant (e.g., natural gas, etc.). It is to be appreciated that the screw compressor 20 includes additional features that are not described in detail in this specification. For example, the screw compressor 20 can include a lubricant sump for storing lubricant to be introduced to the moving components (e.g., motor bearings, etc.) of the screw compressor 20.

The screw compressor 20 includes a compression mechanism that includes a first helical rotor 22 and a second helical rotor 24 disposed in a rotor housing 26. The rotor housing 26 includes a plurality of bores 28A and 28B. The plurality of bores 28A and 28B are configured to accept the first helical rotor 22 and the second helical rotor 24.

The first helical rotor 22, generally referred to as the male rotor, has a plurality of spiral lobes 30. The plurality of spiral lobes 30 of the first helical rotor 22 can be received by a plurality of spiral grooves 32 of the second helical rotor 24, generally referred to as the female rotor. In an embodiment, the spiral lobes 30 and the spiral grooves 32 can alternatively be referred to as the threads 30, 32. The first helical rotor 22 and the second helical rotor 24 are arranged within the housing 26 such that the spiral grooves 32 intermesh with the spiral lobes 30 of the first helical rotor 22.

During operation, the first and second helical rotors 22, 24 rotate counter to each other. That is, the first helical rotor 22 rotates about an axis A in a first direction while the second helical rotor 24 rotates about an axis B in a second direction that is opposite the first direction. Relative to an axial direction that is defined by the axis A of the first helical rotor 22, the screw compressor 20 includes an inlet port 34 and an outlet port 36.

The rotating first and second helical rotors 22, 24 can receive a working fluid (e.g., heat transfer fluid such as refrigerant or the like) at the inlet port 34. The working fluid can be compressed between the spiral lobes 30 and the spiral grooves 32 (in a pocket 38 formed therebetween) and discharged at the outlet port 36. The pocket is generally referred to as the compression chamber 38 and is defined between the spiral lobes 30 and the spiral grooves 32 and an interior surface of the housing 26. In an embodiment, the compression chamber 38 may move from the inlet port 34 to the outlet port 36 when the first and second helical rotors 22, 24 rotate. In an embodiment, the compression chamber 38 may continuously reduce in volume while moving from the inlet port 34 to the discharge port 38. This continuous reduction in volume can compress the working fluid (e.g., heat transfer fluid such as refrigerant or the like) in the compression chamber 38.

Figure 3:
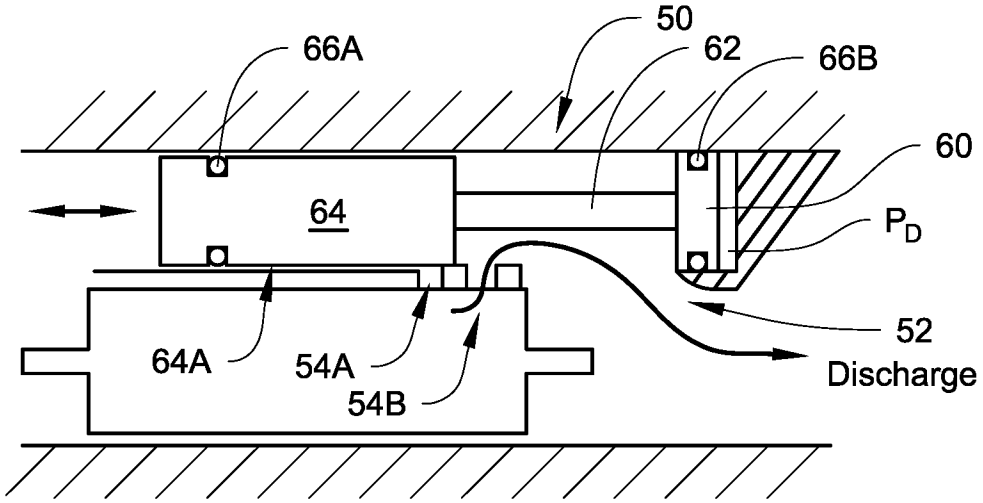
FIG. 3 illustrates a slide piston assembly, according to an embodiment.

FIG. 3 illustrates a slide piston assembly 50, according to an embodiment. The slide piston assembly 50 can, for example, be utilized to modify a fixed volume ratio screw compressor such that the fixed volume ratio screw compressor is a variable volume ratio screw compressor. In the illustrated embodiment, the slide piston assembly 50 can be, for example, a conventional slide piston assembly. However, the slide piston assembly 50 operates differently compared to the conventional slide piston assembly. The slide piston assembly 50 can be incorporated in a compressor (e.g., the compressor 20 of FIG. 2). In an embodiment, the compressor 20 including the slide piston assembly 50 can be included as a compressor in a refrigerant circuit, such as the compressor 12 in the refrigerant circuit 10 (FIG. 1).

More specifically, the slide piston assembly 50 may be reversed relative to the conventional slide piston assembly. That is, the slide piston assembly 50 can be modified such that it is rotated 180°. As a result, the slide piston assembly 50 can be oriented such that working fluid which is vented from the slide piston assembly 50 can be provided to a discharge outlet 52. The discharge outlet 52 may be the same as or similar to the outlet port 36 (FIG. 2). In the conventional slide piston assembly, the working fluid would be vented to suction. In an embodiment, venting the working fluid to the discharge (e.g., discharge outlet 52) can, for example, reduce an amount of overcompression of the working fluid when operating the compressor at a partial load.

In operation, the slide piston assembly 50 can be used to discharge the working fluid being compressed prior to reaching the discharge outlet 52. There may be multiple outlets 54A and 54B via which the slide piston assembly 50 can prevent or allow discharge of the working fluid to the discharge outlet 52. A discharge pressure $P_D$ can determine a location (e.g., left to right in the figure) of the slide piston assembly 50 along a length of the rotor. For example, when a discharge pressure $P_D$ is relatively lower, the discharge may occur at 54A (e.g., relatively earlier in the compression process). As the discharge pressure $P_D$ increases, the slide piston assembly 50 moves to the right in the figure and the discharge of the compressed working fluid moves toward the discharge outlet 52. That is, at a relatively intermediate pressure $P_D$, the slide piston assembly 50 may be disposed such that working fluid can be provided from the outlet 54B, and at a relatively higher pressure $P_D$, the slide piston assembly 50 may be disposed such that the outlets 54A, 54B are fluidly blocked, thereby causing the working fluid to be discharged via the discharge outlet 52.

It will be appreciated that two outlets 54A, 54B are shown by way of example. A different number of outlets 54A, 54B, such as one or more than two, may be included, according to an embodiment. As described above, the slide piston assembly 50 may be passively controlled. In an embodiment, the slide piston assembly 50 can alternatively be actively controlled by an actuation mechanism other than the discharge pressure $P_D$.

The slide piston assembly 50 includes a piston 60 having a connecting rod 62. The connecting rod 62 is connected to a pressure control member 64. The slide piston assembly 50 can include one or more seals or gaskets 66A, 66B. A working fluid at a discharge pressure $P_D$ can be provided to actuate the piston 60, and accordingly the pressure control member 64, between a variety of positions. As the pressure control member 64 is moved, a surface 64A can prevent fluid communication between the outlets 54A, 54B and the discharge outlet 52.

When the outlets 54A and 54B are covered, the compressor has a relatively higher volume ratio. When the outlets 54A and/or 54B are uncovered, the compressor has a relatively lower volume ratio. In an embodiment, providing the working fluid to discharge outlet 52 via outlets 54A and/or 54B can reduce an amount of the working fluid that is overcompressed when operating at a part load condition. In an embodiment, reducing the amount of overcompression can, for example, result in a 10-14 percent increase in part load efficiency.

Figure 4:
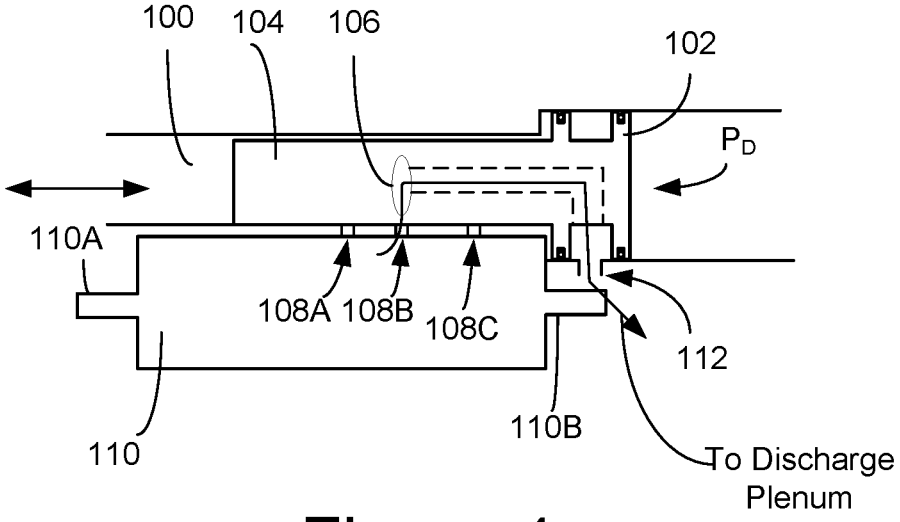
FIG. 4 illustrates a slide piston assembly, according to an embodiment.

FIG. 4 illustrates a slide piston assembly 100, according to an embodiment. The slide piston assembly 100 may be an alternative to the slide piston assembly 50. The slide piston assembly 100 can be incorporated in a compressor (e.g., the compressor 20 of FIG. 2). In an embodiment, the compressor 20 including the slide piston assembly 100 can be included as a compressor in a refrigerant circuit, such as the compressor 12 in the refrigerant circuit 10 (FIG. 1).

The slide piston assembly 100 includes a piston 102 that may be connected to a pressure control member 104. The piston 102 and pressure control member 104 can be configured to move along a length of the rotor 110 (e.g., horizontally left-right in the figure) such that a passageway 106 disposed within the pressure control member 104 aligns with an outlet 108A, 108B, or 108C. The discharge outlets 108A-108C are disposed at locations along the rotor 110 which are between an end 110A of the rotor 110 that is disposed relatively closer to a suction inlet of the working fluid and an end 110B which is disposed relatively closer to a discharge outlet 112 of the rotor 110. The discharge outlet 112 may be the same as or similar to the discharge outlet 36 in FIG. 2. In the illustrated embodiment, three discharge outlets 108A-108C are shown by way of example. It will be appreciated that a number of discharge outlets 108A-108C can vary and can be fewer than or greater than three, according to an embodiment.

In operation, the slide piston assembly 100 is designed such that the passageway 106 can be aligned with one of the discharge outlets 108A-108C to discharge the working fluid prior to reaching the end 110B of the rotor 110 during compression. As a result, working fluid can be discharged relatively earlier in the compression cycle when, for example, the compressor is operating at a part load condition. In an embodiment, the working fluid can be discharged from the discharge outlet 112 when the compressor is operating at a full load capacity. As a result, the compressor including the slide piston assembly 100 can have a relatively greater efficiency when operating at a part load condition. This can, for example, be a result of reducing overcompression of the working fluid at a part load condition.

In operation, the passageway 106 can be aligned with one of the outlets 108A-108C to enable the passageway 106 to fluidly communicate with the one of the outlets 108A-108C and the discharge outlet 112. As a result, the working fluid is provided via the one of the outlets 108A-108C, flows through the passageway 106, and is discharged from the discharge outlet 112. In an embodiment, a location of the slide piston assembly 100 can be determined by, for example, a discharge pressure $P_D$. In such an embodiment, similar to the slide piston assembly 50 in FIG. 3, the slide piston assembly 100 can move such that at a relatively high discharge pressure $P_D$, the slide piston assembly 100 is aligned such that the working fluid is discharged via the discharge outlet 112. As the discharge pressure decreases, the slide piston assembly 100 can be moved such that the passageway 106 aligns with one of the outlets 108A-108C, with 108A being at a relatively lower discharge pressure $P_D$ than 108B, and 108B at a relatively lower discharge pressure $P_D$ than 108C.

When the outlets 108A-108C are covered, the compressor has a relatively higher volume ratio. When the outlets 108A-108C are uncovered, the compressor has a relatively lower volume ratio. In an embodiment, the variable volume ratio compressor, as modified, can include a 10-14 percent increase in part load efficiency. This can, for example, be a result of reducing overcompression of the working fluid at a part load condition.

Aspects:

It is to be appreciated that any one of aspects 1-8 can be combined with any one of aspects 9-12 and/or 13-20. Any one of aspects 9-12 can be combined with any one of aspects 13-20.

Aspect 1. A screw compressor, comprising:

a suction inlet that receives a working fluid to be compressed;

a compression mechanism fluidly connected to the suction inlet that compresses the working fluid;

a discharge outlet fluidly connected to the compression mechanism that outputs the working fluid following compression by the compression mechanism;

wherein the compression mechanism fluidly communicates with one or more outlets disposed at an intermediate location between the suction inlet and the discharge outlet, the one or more outlets being selectively fluidly connectable to the discharge outlet such that the working fluid can be provided from the one or more outlets to the discharge outlet.

Aspect 2. The screw compressor according to aspect 1, wherein the one or more outlets are selectively fluidly connectable via a slide piston assembly.

Aspect 3. The screw compressor according to aspect 2, wherein the slide piston assembly is actuatable based on a discharge pressure of the screw compressor.

Aspect 4. The screw compressor according to aspect 3, wherein when the discharge pressure is relatively highest, the one or more outlets are fluidly blocked from the discharge outlet.

Aspect 5. The screw compressor according to any one of aspects 3 or 4, wherein when the discharge pressure is relatively less than the relatively highest discharge pressure, one of the one or more outlets is fluidly connected to the discharge outlet, such that the working fluid flows from the compression mechanism to the discharge outlet via the one of the one or more outlets.

Aspect 6. The screw compressor according to any one of aspects 2-5, wherein the slide piston assembly includes a piston and a pressure control member.

Aspect 7. The screw compressor according to aspect 6, wherein the pressure control member includes a passageway through the pressure control member, and one of the one or more outlets are fluidly connected to the discharge outlet when the passageway is aligned with the one of the one or more outlets.

Aspect 8. The screw compressor according to any one of aspects 1-7, wherein a variable volume ratio of the screw compressor is relatively highest when the one or more outlets are fluidly blocked and is relatively lower when the one or more outlets fluidly communicate with the compression mechanism and the discharge outlet.

Aspect 9. A method of converting a fixed volume ratio screw compressor to a variable volume ratio screw compressor, comprising:

providing a plurality of outlets that are fluidly communicable with a compression mechanism of the fixed volume ratio screw compressor and fluidly communicable with a discharge outlet of the fixed volume ratio screw compressor; and providing a slide piston assembly that determines which of the plurality of outlets is fluidly connected with the compression mechanism and the discharge outlet.

Aspect 10. The method according to aspect 9, wherein providing the slide piston assembly includes reversing a slide piston assembly of the fixed volume ratio compressor.

Aspect 11. The method according to aspect 9, wherein the plurality of outlets are disposed at locations of the compression mechanism in which a working fluid compressible by the compression mechanism is at an intermediate pressure in operation, the location being between a suction inlet of the fixed volume ratio screw compressor and the discharge outlet.

Aspect 12. The method according to aspect 10, wherein the providing includes retrofitting the fixed volume ratio screw compressor after the fixed volume ratio screw compressor has been operated.

Aspect 13. A refrigerant circuit, comprising:

a compressor, a condenser, an expansion device, and an evaporator fluidly connected;

the compressor including:

a suction inlet that receives a working fluid to be compressed from the evaporator;

a compression mechanism fluidly connected to the suction inlet that compresses the working fluid;

a discharge outlet fluidly connected to the compression mechanism that outputs the working fluid to the condenser following compression by the compression mechanism;

wherein the compression mechanism fluidly communicates with one or more outlets disposed at an intermediate location between the suction inlet and the discharge outlet, the one or more outlets being selectively fluidly connectable to the discharge outlet such that the working fluid can be provided from the one or more outlets to the discharge outlet.

Aspect 14. The refrigerant circuit according to aspect 13, wherein the one or more outlets are selectively fluidly connectable via a slide piston assembly.

Aspect 15. The refrigerant circuit according to aspect 14, wherein the slide piston assembly is actuatable based on a discharge pressure of the screw compressor.

Aspect 16. The refrigerant circuit according to aspect 15, wherein when the discharge pressure is relatively highest, the one or more outlets are fluidly blocked from the discharge outlet.

Aspect 17. The refrigerant circuit according to any one of aspects 15 or 16, wherein when the discharge pressure is relatively less than the relatively highest discharge pressure, one of the one or more outlets is fluidly connected to the discharge outlet, such that the working fluid flows from the compression mechanism to the discharge outlet via the one of the one or more outlets.

Aspect 18. The refrigerant circuit according to any one of aspects 14-17, wherein the slide piston assembly includes a piston and a pressure control member.

Aspect 19. The refrigerant circuit according to aspect 18, wherein the pressure control member includes a passageway through the pressure control member, and one of the one or more outlets are fluidly connected to the discharge outlet when the passageway is aligned with the one of the one or more outlets.

Aspect 20. The refrigerant circuit according to any one of aspects 13-19, wherein a variable volume ratio of the screw compressor is relatively highest when the one or more outlets are fluidly blocked and is relatively lower when the one or more outlets fluidly communicate with the compression mechanism and the discharge outlet.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A screw compressor, comprising:

a suction inlet that receives a working fluid to be compressed;

a compression mechanism fluidly connected to the suction inlet that compresses the working fluid;

a discharge outlet fluidly connected to the compression mechanism that outputs the working fluid following compression by the compression mechanism;

wherein the compression mechanism fluidly communicates with one or more outlets disposed at an intermediate location between the suction inlet and the discharge outlet, the one or more outlets being selectively fluidly connectable to the discharge outlet such that the working fluid can be provided from the one or more outlets to the discharge outlet, the one or more outlets are selectively fluidly connectable via a slide piston assembly, and the slide piston assembly is actuatable by the working fluid at a discharge pressure of the screw compressor applied to a piston of the slide piston assembly downstream of the compression mechanism.

2. The screw compressor according to claim 1, wherein when the discharge pressure is relatively highest, the one or more outlets are fluidly blocked from the discharge outlet.

3. The screw compressor according to claim 2, wherein when the discharge pressure is relatively less than the relatively highest discharge pressure, one of the one or more outlets is fluidly connected to the discharge outlet, such that the working fluid flows from the compression mechanism to the discharge outlet via the one of the one or more outlets.

4. The screw compressor according to claim 1, wherein the slide piston assembly includes a pressure control member.

5. The screw compressor according to claim 4, wherein the pressure control member includes a passageway through the pressure control member, and one of the one or more outlets are fluidly connected to the discharge outlet when the passageway is aligned with the one of the one or more outlets.

6. The screw compressor according to claim 1, wherein a variable volume ratio of the screw compressor is relatively highest when the one or more outlets are fluidly blocked and is relatively lower when the one or more outlets fluidly communicate with the compression mechanism and the discharge outlet.

7. A method of converting a fixed volume ratio screw compressor to a variable volume ratio screw compressor, comprising:

providing a plurality of outlets that are fluidly communicable with a compression mechanism of the fixed volume ratio screw compressor and fluidly communicable with a discharge outlet of the fixed volume ratio screw compressor; and providing a slide piston assembly that determines which outlet of the plurality of outlets is fluidly connected with the compression mechanism and the discharge outlet, wherein the slide piston assembly is actuatable by a working fluid at a discharge pressure of the variable volume ratio screw compressor applied to a piston of the slide piston assembly downstream from the compression mechanism.

8. The method according to claim 7, wherein providing the slide piston assembly includes reversing the slide piston assembly of the fixed volume ratio compressor.

9. The method according to claim 8, wherein the providing includes retrofitting the fixed volume ratio screw compressor after the fixed volume ratio screw compressor has been operated.

10. The method according to claim 7, wherein the plurality of outlets are disposed at locations of the compression mechanism in which a working fluid compressible by the compression mechanism is at an intermediate pressure in operation, the location being between a suction inlet of the fixed volume ratio screw compressor and the discharge outlet.

11. A refrigerant circuit, comprising:

a compressor, a condenser, and an evaporator fluidly connected;

the compressor including:

a suction inlet that receives a working fluid to be compressed from the evaporator;

a compression mechanism fluidly connected to the suction inlet that compresses the working fluid;

a discharge outlet fluidly connected to the compression mechanism that outputs the working fluid to the condenser following compression by the compression mechanism;

wherein the compression mechanism fluidly communicates with one or more outlets disposed at an intermediate location between the suction inlet and the discharge outlet, the one or more outlets being selectively fluidly connectable to the discharge outlet such that the working fluid can be provided from the one or more outlets to the discharge outlet, the one or more outlets are selectively fluidly connectable via a slide piston assembly, and the slide piston assembly is actuatable by the working fluid at a discharge pressure of the compressor applied to a piston of the slide piston assembly downstream of the compression mechanism.

12. The refrigerant circuit according to claim 11, wherein when the discharge pressure is relatively highest, the one or more outlets are fluidly blocked from the discharge outlet.

13. The refrigerant circuit according to claim 12, wherein when the discharge pressure is relatively less than the relatively highest discharge pressure, one of the one or more outlets is fluidly connected to the discharge outlet, such that the working fluid flows from the compression mechanism to the discharge outlet via the one of the one or more outlets.

14. The refrigerant circuit according to claim 11, wherein the slide piston assembly includes a pressure control member.

15. The refrigerant circuit according to claim 14, wherein the pressure control member includes a passageway through the pressure control member, and one of the one or more outlets are fluidly connected to the discharge outlet when the passageway is aligned with the one of the one or more outlets.

16. The refrigerant circuit according to claim 11, wherein a variable volume ratio of the screw compressor is relatively highest when the one or more outlets are fluidly blocked and is relatively lower when the one or more outlets fluidly communicate with the compression mechanism and the discharge outlet.

* * * * *